US007313847B1

(12) United States Patent
Felix et al.

(10) Patent No.: US 7,313,847 B1
(45) Date of Patent: Jan. 1, 2008

(54) CTF FLIP-N-ZIP SLIDER

(76) Inventors: Christopher Theodore Felix, 14700 Quail Grove Cir., Oregon City, OR (US) 97045; James Marvin Williams, P.O. 2737, Oregon City, OR (US) 97045

( * ) Notice: Subject to any disclaimer, the term of this patent is extended or adjusted under 35 U.S.C. 154(b) by 6 days.

(21) Appl. No.: 11/486,124

(22) Filed: Jul. 14, 2006

(51) Int. Cl.
*A44B 19/26* (2006.01)

(52) U.S. Cl. ..... 24/426; 24/415; 24/416; 24/417; 24/418; 24/421; 24/435; 24/429

(58) Field of Classification Search ..... 24/415, 24/426, 421, 417, 416, 381, 435
See application file for complete search history.

(56) References Cited

U.S. PATENT DOCUMENTS 2,792,611 A * 5/1957 Morin ..... 24/416
2,794,230 A * 6/1957 Carlile ..... 24/416
2,811,764 A * 11/1957 Morin ..... 24/416
2,821,765 A * 2/1958 Morin ..... 24/416
2,890,512 A * 6/1959 Stilwell ..... 24/416
4,023,244 A * 5/1977 Doguchi et al. ..... 24/416
5,625,927 A * 5/1997 Chu ..... 24/421
5,864,928 A * 2/1999 Matsushima ..... 24/421
5,940,941 A * 8/1999 Dishner et al. ..... 24/381

* cited by examiner

*Primary Examiner*—J J Swann
*Assistant Examiner*—Marcus Menezes

(57) ABSTRACT

The CTF Flip-N-Zip slider enables the purchasers of a zipper with the CTF Flip-N-Zip slider installed to disconnect at least one side of a zipped zipper and return it to the starting position. Current fixed sliders are very hard to fix if a foreign object jams the zipper or if the zipper opens behind the slider. CTF Flip-N-Zip slider requires only that the owner disengage the lock and remove either the top or bottom plates or half plate depending on the design. This is shown in the drawings for a releasable latch pin of the slider. The owner would then return the zipper to the starting position and reattach and lock the slider and start over using the same slider. Other designs currently in consideration are push button releases, hinged plates with hidden lever, draw activated releases, etc. Sliders will be made to fit all available zippers and zipper materials.

6 Claims, 3 Drawing Sheets

Fig. 1
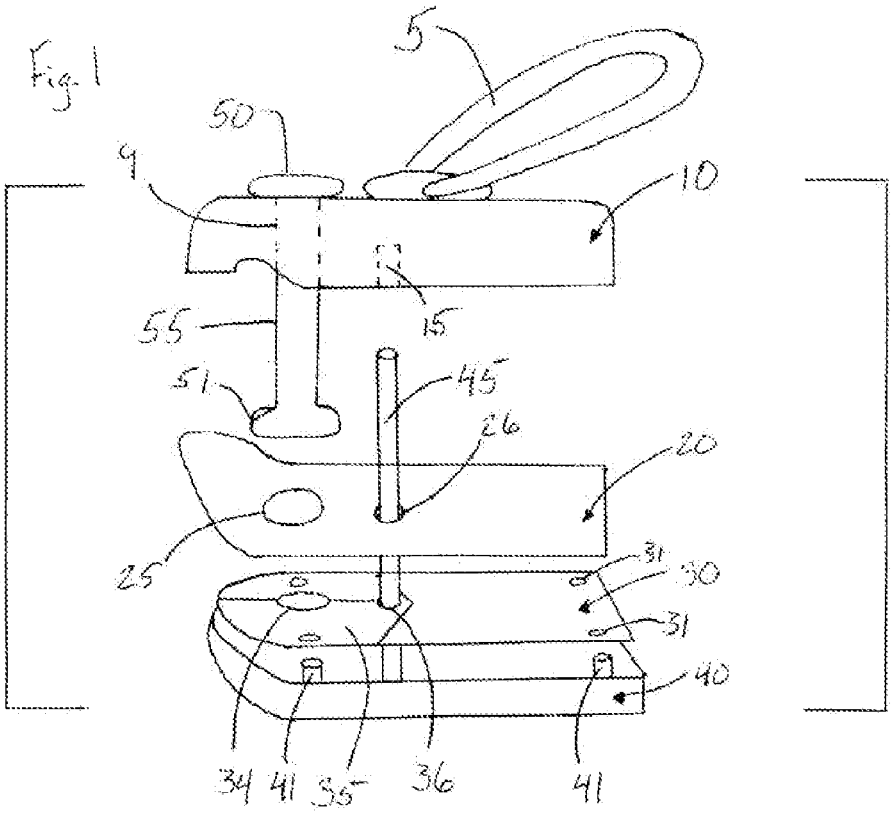
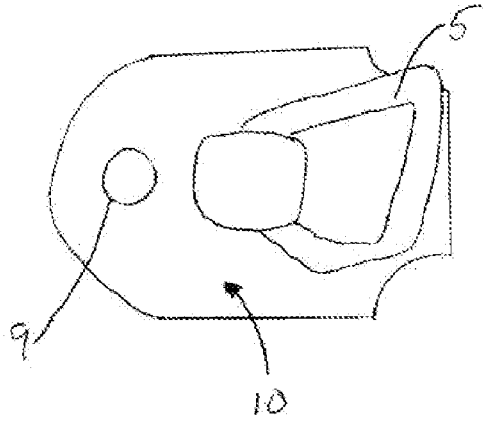
Fig. 2
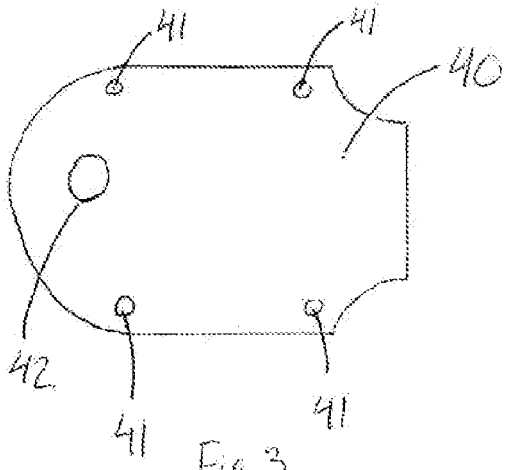
Fig. 3

CTF FLIP-N-ZIP SLIDER

CROSS-RELATED APPLICATIONS

Not Applicable

STATEMENT REGARDING FEDERALLY SPONSORED RESEARCH OR DEVELOPMENT

No federal funds were used in the research or development of prototypes.

REFERENCE TO SEQUENCE LISTING, A TABLE

Not Applicable

BACKGROUND OF INVENTION

This invention occurred because a zipper opened below the slider and jammed it on Christopher Felix's leather jacket. The standard commercial world wanted $75 to repair the jacket, by sewing on a new zipper. This made Christopher angry so he considered alternatives and the drawings that follow are the result of that thought process. This device will repair itself by disengaging the slider so the jams can be repaired.

BRIEF SUMMARY OF INVENTION

Our current prototypes are made from commercially available zipper sliders. We have added a button that releases the bottom plate of the zipper slider. This allows disengagement of the zipper slider from the zipper. You may then repair the zipper and return the slider to the starting position, and reengage the zipper slider by releasing the button.

BRIEF DESCRIPTION OF THE SEVERAL VIEWS OF THE DRAWING

The present invention is illustrated by way of example, and not by way of limitation in the figures of the accompanying drawings in which like reference numerals refer to similar elements and in which:

FIG. 1 is an assembly view of a preferred embodiment of the present invention.

FIG. 2 is a top view of the top plate of FIG. 1.

FIG. 3 is a top view of the bottom plate of FIG. 1.

DETAILED DESCRIPTION OF THE INVENTION

Figure 4:
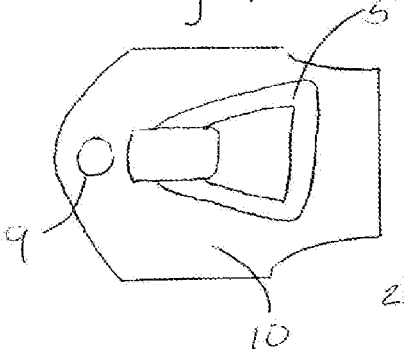
FIG. 4 is a top view of the top plate of FIG. 1.

The present invention solves problems of zippers becoming separated, stuck or jammed by providing a zipper slide as discussed below. One of ordinary skill in the art will realize that the following discussion is illustrative and intended to describe preferred embodiments of the present invention and is not intended to limit the present invention to the embodiments discussed.

Referring now to the drawings, and initially to FIG. 1, an improved zipper slider is described. A top plate 10 has a handle 5 for moving the improved zipper slider along a zipper. An aperture 9 in the top plate permits a locking latch pin 55 to slidably pass through top plate 10. Locking latch pin 55 has bulbous ends 50 and 51 which retain locking latch pin 55 within aperture 9. Locking latch pin 55 is made from steel or other hard, durable material. An aperture 15 receives a second steel pin 45 which is used to keep the bottom plate 40 aligned with the top plate 10.

The zipper bottom 20 cooperates with the top plate 10 to define channels 60 through which a zipper passes during the process of zipping and unzipping the zipper. An aperture 25 permits locking latch pin 55 to pass through the zipper bottom 20. An aperture 26 permits the second steel pin 45 to pass through the zipper bottom 20.

A spring plate latch 30 comprises a spring area 35. Spring area 35 contains an aperture 34 to permit locking latch pin 55 to pass through the spring plate latch 30. Spring area 35 also contains an aperture 36 to permit the second steel pin 45 to pass through the spring plate latch 30. Apertures 31 in the spring plate latch 30 permit security pins 41 to pass through the spring plate latch 30 and into the zipper bottom 20.

Security pins 41 are secured to the bottom plate 40. The second steel pin 45 is also secured to the bottom plate 40. In this manner, the security pins 41 keep the zipper bottom 20 aligned with the bottom plate 40 that keeps the whole assembly aligned and the proper distance from the top zipper slider plate via locking latch pin 55 and the second steel pin 45.

Figure 8:
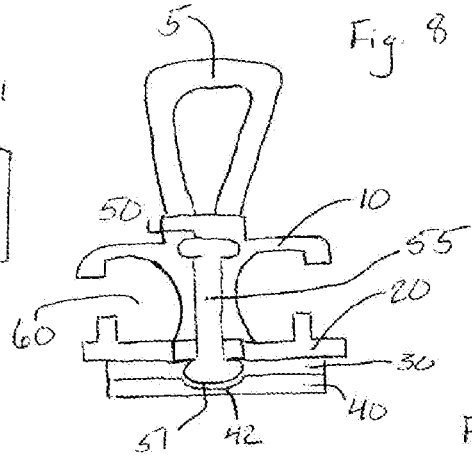
FIG. 8 is a front cut-away view of the embodiment of FIG. 1.

Referring now to FIG. 8, it is seen that locking latch pin 55 holds top plate 10 in place via bulbous end 50. It is also seen that bulbous end 51 of locking latch pin 55 is retained between the bottom plate 40 and the spring plate latch 30. Thus, bulbous end 51 rests in depression 42 in the bottom plate 40.

Figure 5:
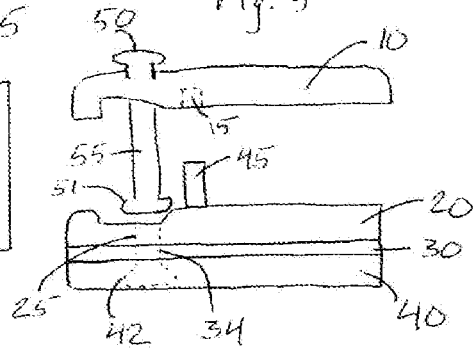
FIG. 5 is a partially assembled side view of the embodiment of FIG. 1.
Figure 6:
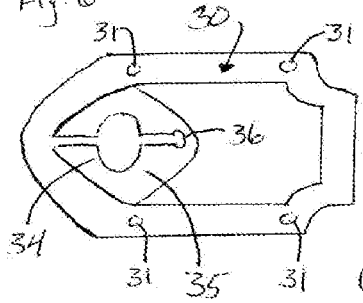
FIG. 6 is a top view of the spring plate latch of FIG. 1 in an open position.
Figure 7:
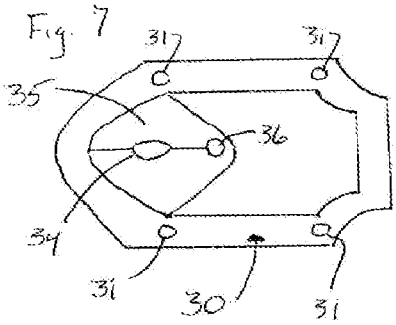
FIG. 7 is a top view of the spring plate latch of FIG. 1 is a closed position.
Figure 9:
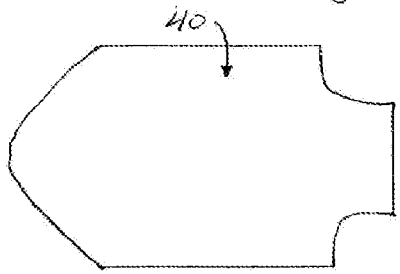
FIG. 9 is a bottom view of the bottom plate of FIG. 1.

Referring now to FIG. 5, operation of the improved zipper slider is described. In the event a zipper becomes separated behind the zipper, or the zipper slider becomes jammed due to fabric entering a zipper channel 60 a user can disengage the inventive zipper slider. Disengagement is accomplished by pulling on bulbous end 50 of locking latch pin 55. This causes the spring plate latch 30 to flex in the spring area 35, as depicted in FIG. 6. As seen in FIG. 6, flexing the spring area 35 causes aperture 34 to enlarge as the spring area 35 is deformed. For a minor pull on bulbous end 50, spring area 35 flexes and enlarges aperture 34 thus permitting the top plate 10 to move away from the zipper bottom 20. If the user stops pulling at this point, spring area 35 returns to its original position, depicted in FIG. 7, thus pushing on the bulbous end 51 and causing the locking latch pin 55 to move the top plate 10 back towards the zipper bottom 20. However, if the user continues to pull on the bulbous end 50, spring area 35 flexes to the point where aperture 34 opens enough to permit bulbous end 51 to pass therethrough. When this happens, the inventive zipper slide is separated into two pieces as depicted in FIG. 5. The inventive zipper slide can then be put back together by pushing bulbous end 51 back through aperture 34.

Figure 10:
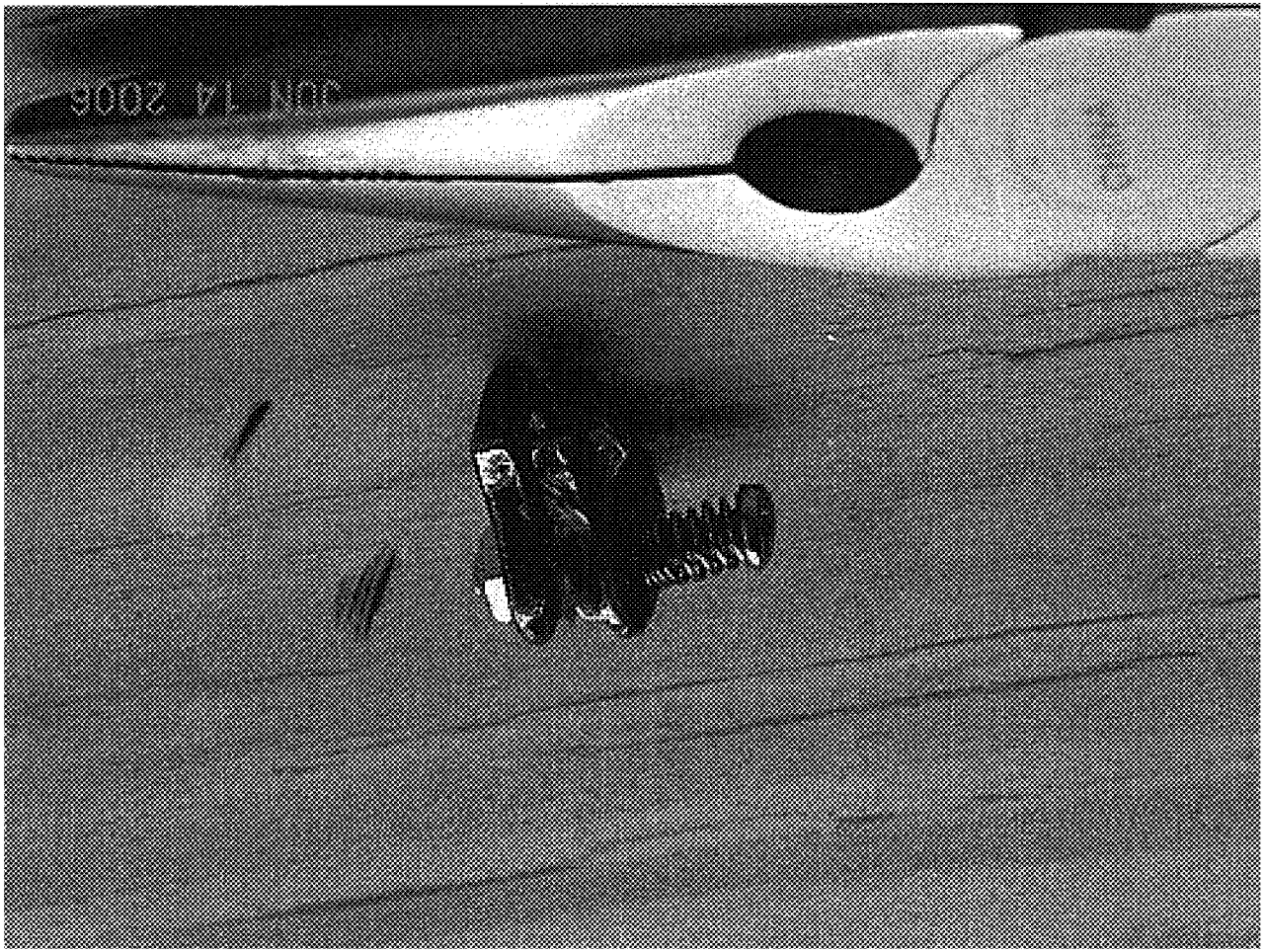
FIG. 10 is a perspective view of a second embodiment of the present invention.

In the manufacturing, of this invention none of our prototypes will require the bottom plate. The drawings are to provide some understanding of the concept. Referring to FIG. 10, the first useful prototype was a button on top of the pull area. This is spring controlled to keep the bottom plate in position when the button is not depressed. The zipper pull goes over the button without pulling on it so it does not release un-intentionally. There are two steel pins through the solid part of the zipper that keep the bottom plate aligned even when the button is depressed. Other types of releasable zipper sliders we are considering are levers and hinges that release only one side, rotating top or bottom plates of the zipper slider, or any lever and pin releases. In fact the concept is any repairable zipper slider.

We claim:

1. A zipper slide comprising:

a top plate movably connected to a bottom plate;

at least one zipper channel at least partially formed by the top plate;

a first pin engaging the top plate and the bottom plate;

a second pin engaging the top plate and the bottom plate;

a spring that acts on the first pin to urge the top plate towards the bottom plate; and a zipper bottom containing a first aperture and a second aperture disposed between the top plate and the bottom plate; and the spring is composed of a spring plate latch containing a first aperture and a second aperture disposed between the zipper bottom and the bottom plate; wherein the zipper bottom first aperture and the spring plate latch first aperture are configured to permit the first pin to pass therethrough; and the zipper bottom second aperture and the spring plate latch second aperture are configured to permit the second pin to pass therethrough.

2. The zipper slide according to claim 1, wherein:

the first pin has a bulbous first end and a bulbous second end; and the bulbous first end is disposed on the side of the top plate that is most distant from the bottom plate;

the bulbous second end is disposed between the spring plate latch and the bottom plate; and the spring plate latch engages the bulbous second end to force the bulbous second end towards the bottom plate.

3. The zipper slide according to claim 2, wherein:

the spring plate latch first aperture is configured to enlarge when the spring plate latch is deformed.

4. The zipper slide according to claim 3, wherein:

the spring plate latch first aperture is configured to enlarge enough to permit the bulbous second end to pass therethrough when the spring plate latch is deformed.

5. A zipper slide comprising:

a top plate movably connected to a bottom plate;

a zipper bottom containing a first aperture and a second aperture disposed proximate the top plate;

a spring plate latch containing a first aperture and a second aperture disposed between the zipper bottom and the bottom plate;

at least one zipper channel formed by the top plate and the zipper bottom plate;

a first pin having a bulbous first end and a bulbous second end, wherein the bulbous first end is disposed on the side of the top plate that is most distant from the bottom plate and the bulbous second end is disposed between the spring plate latch and the bottom plate;

a second pin engaging the top plate and the bottom plate;

the zipper bottom first aperture and the spring plate latch first aperture are configured to permit the first pin to pass therethrough;

the zipper bottom second aperture and the spring plate latch second aperture are configured to permit the second pin to pass therethrough; and the spring plate latch engages the bulbous second end to force the bulbous second end towards the bottom plate.

6. A zipper slide comprising:

a top plate movably connected to a bottom plate;

at least one zipper channel formed by the top plate and the bottom plate;

a first pin engaging the top plate and the bottom plate;

a second pin engaging the top plate and the bottom plate;

a spring circumferentially disposed about the first pin that acts on the first pin to urge the top plate towards the bottom plate; and wherein the top plate completely separates from the bottom plate by pulling the first pin away from the bottom plate for disengaging the zipper slide from a zipper and the top plate is movably connected to the bottom plate for re-engaging the zipper slide to a zipper by pushing the first pin towards the bottom plate.

* * * * *